US005734354A

United States Patent [19]

Twelves

[11] Patent Number: 5,734,354

[45] Date of Patent: Mar. 31, 1998

[54] FLAT PLATE ANTENNA

[75] Inventor: Alan Twelves, Torquay, United Kingdom

[73] Assignee: Northern Telecom Limited, Montreal, Canada

[21] Appl. No.: 554,986

[22] Filed: Nov. 13, 1995

Related U.S. Application Data

[63] Continuation-in-part of Ser. No. 294,105, Aug. 22, 1994, abandoned, which is a continuation of Ser. No. 984,183, Nov. 20, 1992, abandoned.

[51] Int. Cl.[6] ..... H01Q 1/38; H01Q 13/10

[52] U.S. Cl. ..... 343/815; 343/770; 343/700 MS

[58] Field of Search ..... 343/815, 778, 343/700 MS, 770, 776, 777, 772, 872; 333/21 A, 256, 257, 261; H01Q 1/38, 13/10

[56] References Cited

U.S. PATENT DOCUMENTS 2,759,099 8/1956 Olive ..... 333/21 A 4,486,758 12/1984 De Ronde ..... 343/700 MS 4,672,687 6/1987 Horton et al. ..... 455/277

*Primary Examiner*—Hoanganh T. Le

*Attorney, Agent, or Firm*—Lee, Mann, Smith, McWilliams, Sweeney & Ohlson

[57] ABSTRACT

A dual polarized flat plate antenna structure has a single circular waveguide output accommodating probes for separate orthogonally polarized signals. A housing to be affixed to the antenna structure contains a low noise block having a single circular waveguide input with complementary probes. The housing is rotatable relative to the antenna structure about the common axis of the waveguides. The low noise block incorporates switching means for selectively coupling the output signals of the antenna array structure with a common low noise block input circuit. Rotation of the low noise block enables the angle of the polarizing coupling between the array output probes and the low noise block input probes to be varied.

6 Claims, 4 Drawing Sheets

FLAT PLATE ANTENNA

RELATED APPLICATIONS

This application is a continuation-in-part of application Ser. No. 294,105, filed Aug. 22, 1994, now abandoned, which is a continuation of application Ser. No. 984,183, filed Nov. 20, 1992, now abandoned.

FIELD OF THE INVENTION

This invention relates to a flat plate antenna for receiving polarized r.f. signals.

DESCRIPTION OF RELATED ART

With the advent of direct broadcast satellite (DBS) television services the so-called "plat plate antenna" (FPA) has been developed to provide a low cost, compact, low maintenance, easy to install and relatively unobtrusive antenna for DBS applications. In general such antennas comprise a flat array of receiving element s all connected by a feed network to a common signal output which is usually coupled to a combined down converter and pre-amplifier unit known as a "low noise block" (LNB) affixed to the rear of the FPA.

In order to avoid interference between different DBS services, these DBS services transmit signals having similar frequencies but with different polarizations of the r.f. signals, so that a FPA arrayed to receive one DBS transmission will not receive another DBS transmission serving the same (or another) geographical area. This avoids interference between the signals. However, it also means that a single design of antenna cannot be utilised for any required polarization. It is also proposed that non-satellite radio systems operate in two modes of polarization.

It is known to construct a dual polarized FPA having two separate element arrays each having a particular polarization, with both arrays being coupled to the LNB. Selection of one of the polarization sis effected by a switchable circuit in the LNB. Such an antenna operates at one or other of two distinct, fixed polarizations, and we have found that this can present a problem because the signal polarization may not in fact be properly aligned with the element array concerned, with a resultant reduction in received signal strength of the desired polarization together with a coupling of the signal having the other polarization, which signal is unwanted.

The present invention seeks to provide a flat plate antenna having a simple construction which overcomes the problem of alignment of a signal polarization with its respective element array.

SUMMARY OF THE INVENTION

According to the present invention there is provided a flat plate antenna structure having two separate element arrays in closely spaced parallel relation, the two arrays having respective signal polarizations orthogonal to one another, the antenna structure having a single circular waveguide output feed, the two arrays each having a respective probe coupling into said circular waveguide output feed, the respective probe couplings being in orthogonal relationship one to the other, the antenna structure being provided with a housing containing a low noise block having a circular waveguide input feed adapted to be coupled into the circular waveguide output feed of the antenna structure, said circular waveguide input feed having probe couplings in orthogonal relationship one to the other corresponding to and cooperative with respective probe couplings in the array circular waveguide output feed, the low noise block within the housing incorporating switching means for selecting one or other of the orthogonally polarized signals coupled from an output probe to a corresponding input probe, the housing when coupled to the antenna array structure being rotatable relative to the antenna array structure about the common axis of the circular waveguides whereby the angle of the polarizing coupling between the array output probes and the low noise block input probes can be varied.

BRIEF DESCRIPTION OF THE DRAWINGS

Embodiments of the invention will now be described with reference to the accompanying drawings, wherein.

DESCRIPTION OF THE PREFERRED EMBODIMENT

Figure 1:
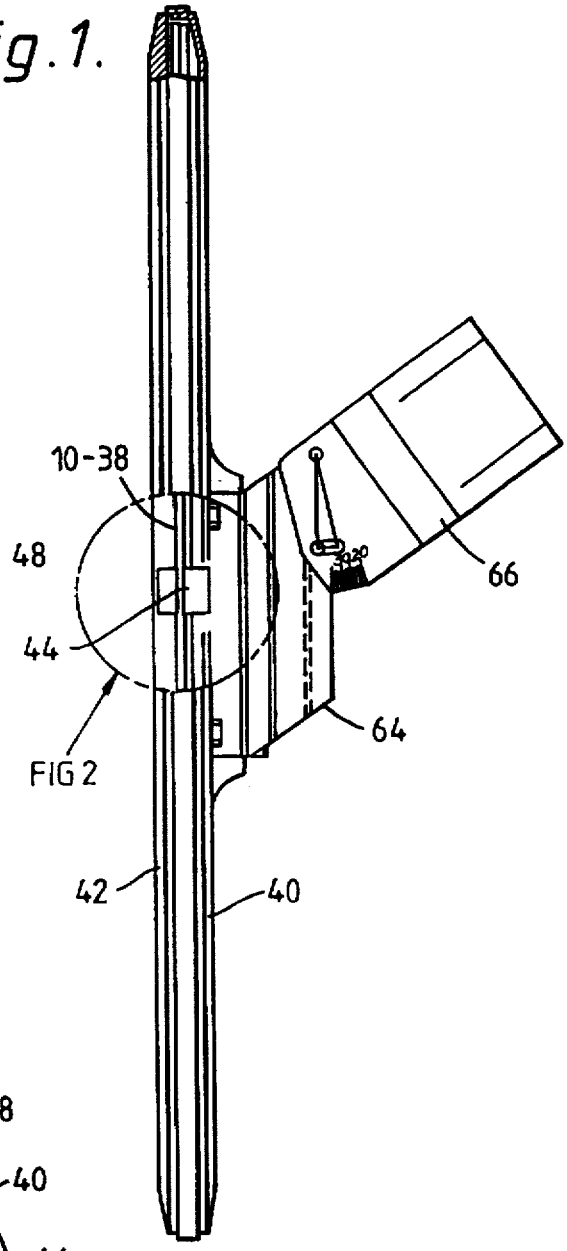
FIG. 1 illustrates a sectional side view of a flat plate antenna structure.

In the flat plate antenna structure shown in the drawings two thin dielectric films 10, 12, e.g. of polyester, have printed thereon conductor patterns forming probes 14, 16 and respective feed networks 18, 20 for respective first and second element arrays. The films 10, 12 are separated by two foam dielectric sheets 22, 24 sandwiching a metallic middle aperture plate 26. Further foam dielectric sheets 28, 30 space the dielectric films 10, 12 from outer metallic aperture plates 32, 34. The three aperture plates have corresponding arrays of circular apertures which are aligned with one another and with the two intervening arrays of element probes. The probes of the two arrays are orthogonal one to the other and the physical arrangement of the element probes in relation to each other and to the aligned apertures corresponds to the physical arrangement of the probes in the circular waveguide shown in FIG. 5*a* and to be described later. Suffice it to say that the arrangement of dielectric films, spacing foam dielectric sheets and metallic aperture plates is well known in the art. The front side of the antenna has a comparatively thick, polystyrene spacer sheet 36 laid over the outer aperture plate 32. The rear side of the antenna has a further unapertured metallic reflector plate 38. The antenna is encased in a housing comprising a plastics base 40 and a radome cover 42. The plastics base has formed on the inner surface thereof a number of pillars 54 some of which are detailed to accept self tapping screws and some of which are shouldered at appropriate heights to act as spacing means for the various components in the sandwiched structure. For example, the spacing between the rear aperture plate 34 and the reflector plate 38 is effected by shouldered pillars passing through fixing and locating holes in the plates. The various components are assembled in sandwich form with fixing screws passing through the films and sheets to hold the internal components in a secure, aligned and spaced arrangement affixed to the inner side of the base 40. Finally the radome cover 42 is fitted over and secured by adhesive sealing round the edge joint with the base 40.

Figure 4:
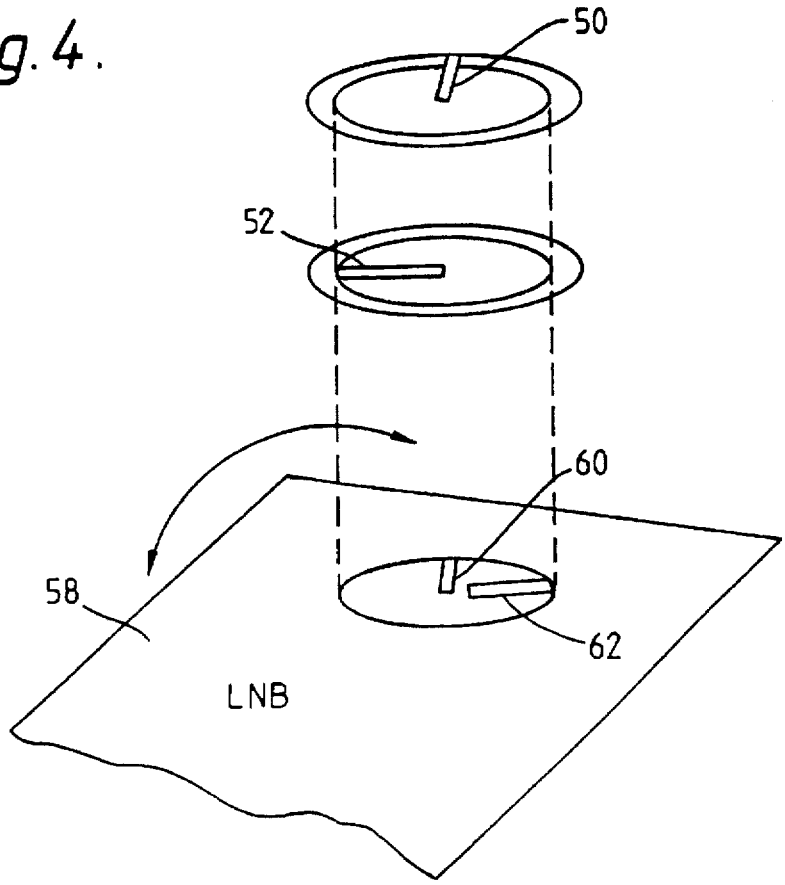
FIG. 4 illustrates a perspective view of the arrangement of coupling probes in the antenna structure of FIGS. 1–3.

Located at or near the centre of the antenna is a circular waveguide output arrangement consisting of a waveguide skirt 44, two waveguide spacers 46 and a waveguide cover 48. The outer aperture plates 32, 34 have apertures sized to accommodate the waveguide structure, likewise the rear reflector plate 38 and the plastics base 40. The two dielectric films 10, 12 are unapertured and each includes as part of its printed circuit pattern a short length of conductor 50, 52 extending part-way into the circular waveguide space 55. The two lengths of conductor 50, 52 form probes coupling into the waveguide and are arranged orthogonally, as shown in the exploded perspective view of FIG. 4. The waveguide skirt 44 is recessed to allow insertion from outside the housing of a circular waveguide part 56 forming a waveguide input to a low noise block within a housing 58.

Figure 6:
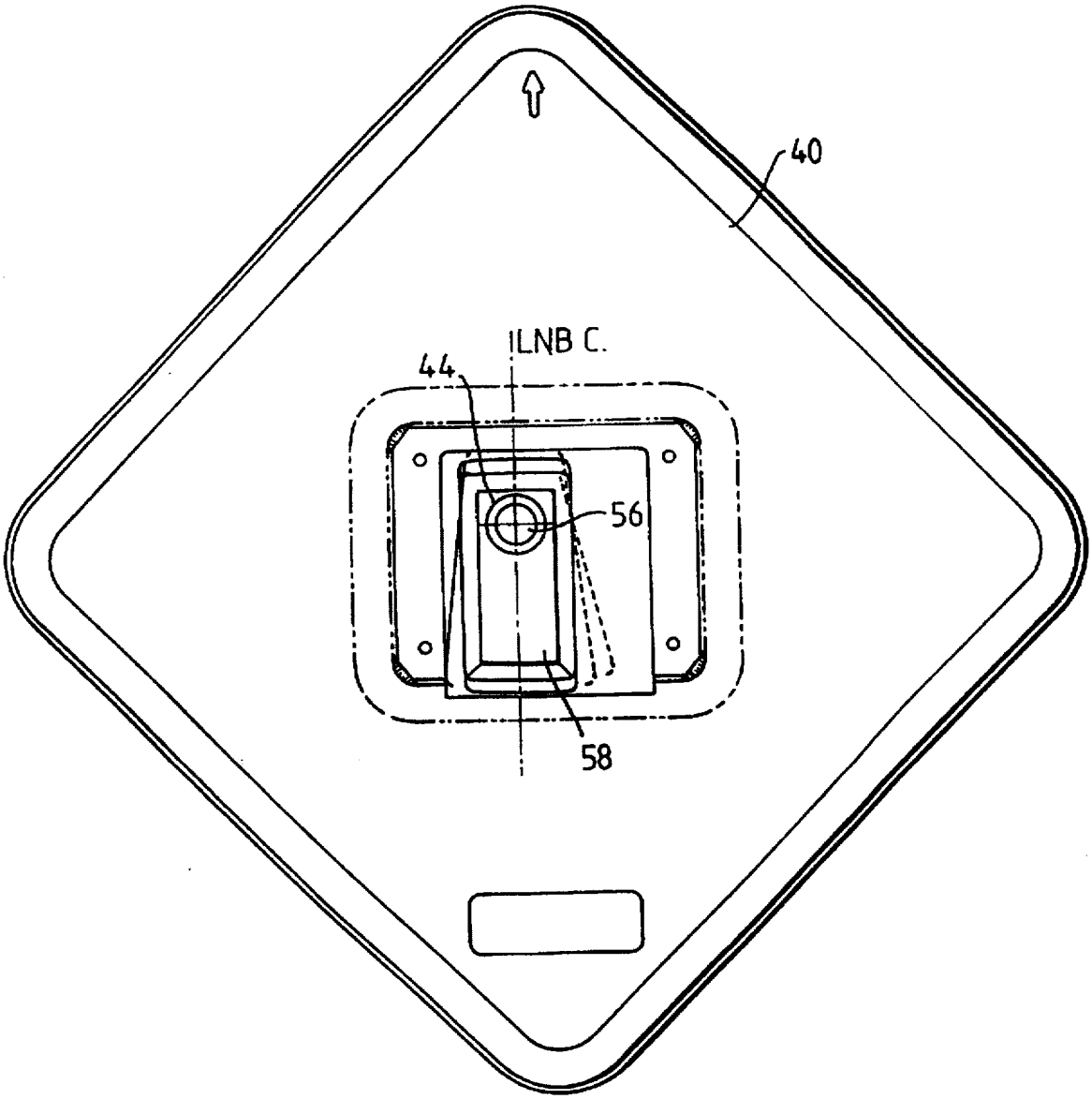
FIG. 6 illustrates rotation of the low noise block relative to the antenna structure.

The waveguide input 56 also has two orthogonally arranged probes 60, 62 (FIG. 4) which are selectively coupled by a switching means (not shown)forming part of an input circuit to the low noise block. The low noise block housing 58 is movably attached to the plastics base 40 so that the circular waveguide part 56 when engaged in the recess in the waveguide skirt 44 acts as a pivot, allowing the low noise block to be rotated with respect to the flat plate antenna structure. The low noise block has switching means so that it is switchable whereby it may be switched to receive either vertical or horizontal polarized signals. FIG. 6 shows a rear view of the antenna base 40 with the low noise block housing 58. The rear surface of the base 40 is contoured to provide a suitable fixing of the low noise block housing while at the same time allowing the housing to be rotated relative to the base, as indicated by the dotted outlines in FIG. 6.

Figure 2:
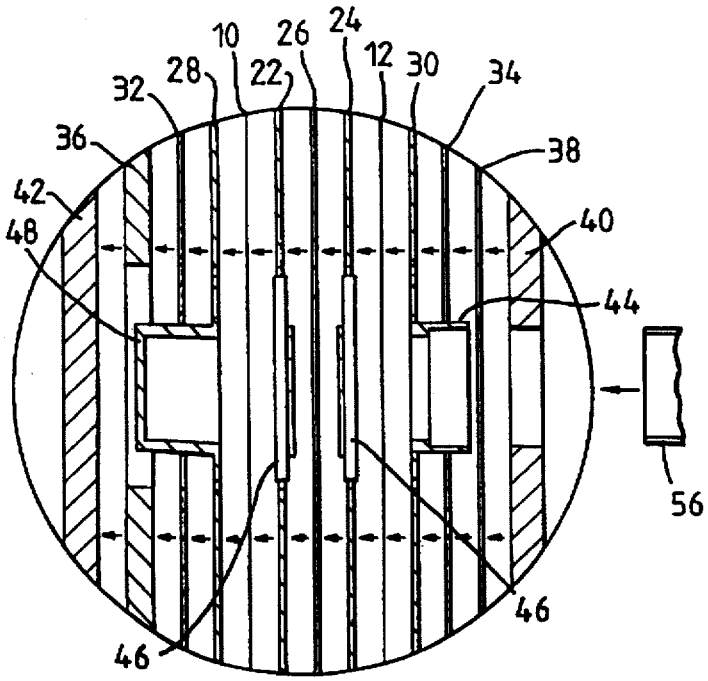
FIG. 2 illustrates a detail of the FPA of FIG. 1.
Figure 3:
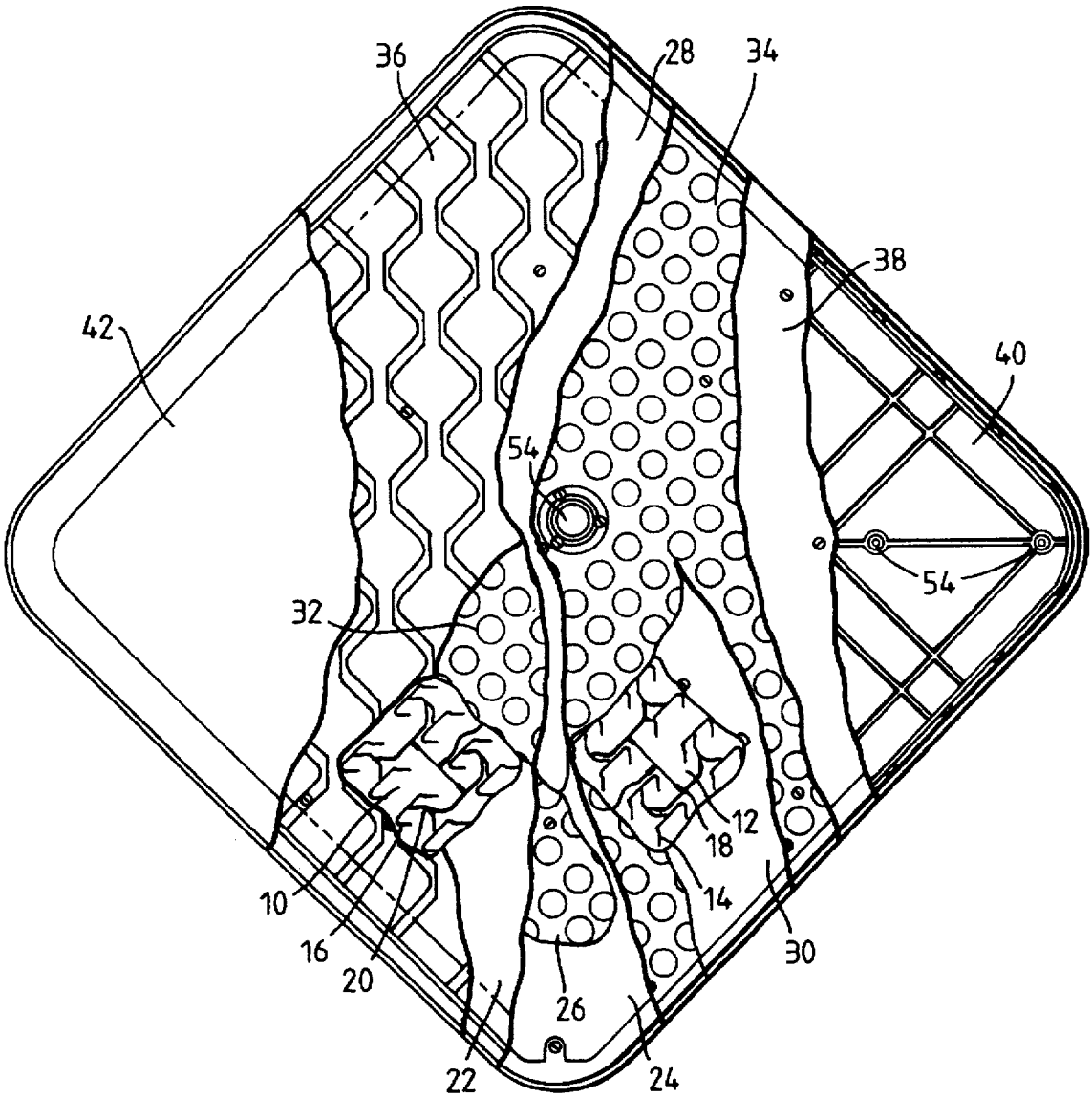
FIG. 3 illustrates a sectional plan view of the FPA of FIGS. 1 and 2.
Figure 5:
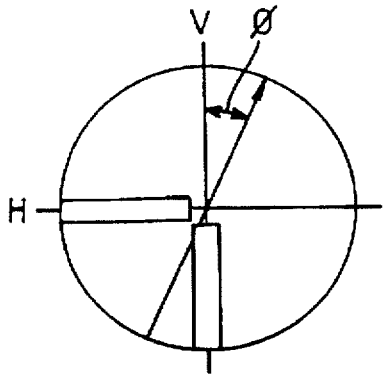
FIGS. 5*a*–5*b* illustrate the physical arrangement of orthogonal probes in a circular waveguide and their vector relationship respectively.
Figure 5:
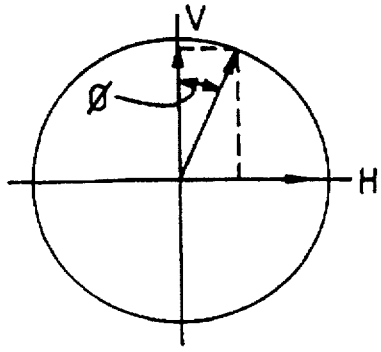

FIG. 5*a* shows the wanted E vector of the incident signal relative to the misaligned orthogonal V and H elements of the antenna film. The vector is resolved into V and H components as in FIG. 5*b* and each component is conducted in its respective V and H circuit films 10 and 12 of FIG. 2. At the antenna output the signals from the V and H elements are combined to product a vector in the same alignment as the original incident signal, FIG. 5*b* and launch it into the circular waveguide space 55. Naturally the unwanted E vector, orthogonal to the wanted vector, will be similarly resolved and launched in its original alignment into the circular waveguide.

If the electric field vector at the antenna has a voltage E, then the V and H components are:

$$V = E\cos\phi$$

$$H = E\sin\phi$$

where $\phi$=angle of E from vertical probe.

In the circular waveguide the resulting transmitted polarization is given by:

$$\begin{aligned} ET &= V + H \\ &= \underset{\text{(magnitude)}}{V2 + H2} \; \underset{\text{(angle)}}{\frac{\tan - 1H}{V}} \\ &= E(\cos^2\phi + \sin^2\phi)^{1/2} \text{ at } \tan^{-1}\frac{E\sin\phi}{E\cos\phi} \\ &= E \text{ magnitude in direction of } \phi\text{. i.e. the} \\ &\quad \text{same as that incident on the antenna.} \end{aligned}$$

At the output of the circular waveguide 56, these vectors are incident on the probes 60, 62 of the low noise block; the particular probe, corresponding with the wanted vector, being selected by switching means within the low noise block. Rotation of the low noise block about the longtitudinal axis of the circular waveguide enables the selected probe to be aligned with the wanted E vector in the waveguide, maximising the power transfer to the receiver in the low noise block. By this means of changing the alignment between the V and H elements in the antenna and the selected probe in the LNB, compensation can be achieved for the original misalignment of the antenna and the signal E vector.

While the flat plate antenna structure described and shown in the drawings is one having orthogonal probes aligned with simple circular apertures the invention is not restricted to this form of antenna element array. It is equally applicable to other forms of dual polarized antenna element arrays such as those using radiating patches, non-circular apertures, crossed slots and other well known variants, including elements having capacitive coupled radiating elements.

The complete antenna structure with the low noise block housing 58 attached to the rear plastics base 40 is mounted in a conventional manner by means of a bracket 64 secured to the base and adjustably connected to a support member 66 for fixing to a pole or wall bracket (not shown) on a building or other structure.

I claim:

1. A flat plate antenna structure having two separate element arrays in closely spaced parallel relation, the two arrays having respective signal polarizations orthogonal to one another, the antenna structure having a single circular waveguide output feed, the two arrays each having a respective probe coupling into said circular waveguide output feed, the respective probe couplings being in orthogonal relationship with each other, the antenna structure being provided with a housing containing a low noise block having a circular waveguide input feed adapted to be coupled into the circular waveguide output feed of the antenna structure, said circular waveguide input feed having probe couplings in orthogonal relationship with each other corresponding to and cooperative with respective probe couplings in the array circular waveguide output feed, the low noise block within the housing incorporating switching means for selecting one or other of the orthogonally polarized signals coupled from an output probe to a corresponding input probe, the housing when coupled to the antenna array structure being rotatable relative to the antenna array structure about the common axis of the circular waveguides whereby the angle of the polarizing coupling between the array output probes and the low noise block input probes can be varied.

2. An antenna according to claim 1 wherein the two element arrays provide respective pairs of orthogonally arranged probes aligned with correspondingly apertured metallic plates, the two element arrays and apertured plates being spaced with intervening dielectric.

3. An antenna according to claim 2 wherein the intervening dielectric is foamed dielectric sheet which acts as a spacing means.

4. An antenna according to claim 3 wherein the two element arrays are in alternating spaced relationship with three apertured plates in a sandwiched construction.

5. An antenna according to claim 3 further including a rear reflector metallic plate spaced from the aperture plate or element array nearest the low noise block, the reflector plate being unapertured except to allow access to the antenna waveguide and to make provision for fixing screws and support pillars.

6. An antenna according to claim 2 further including a rear reflector metallic plate spaced from the aperture plate or element array nearest the low noise block, the reflector plate being unapertured except to allow access to the antenna waveguide and to make provision for fixing screws and support pillars.

* * * * *